US005146727A

United States Patent [19]

Hansson

[11] Patent Number: 5,146,727

[45] Date of Patent: Sep. 15, 1992

[54] CLADDING PANEL

[75] Inventor: Sören Hansson, Kalix, Sweden

[73] Assignee: NPF Nordisk Platformning AB, Alvsbyn, Sweden

[21] Appl. No.: 758,458

[22] Filed: Sep. 6, 1991

Related U.S. Application Data

[63] Continuation of Ser. No. 476,472, filed as PCT/SE88/00663, Dec. 5, 1988, abandoned.

[30] Foreign Application Priority Data

Dec. 7, 1987 [SE] Sweden ..... 8704873

[51] Int. Cl.[5] ..... E04D 1/00

[52] U.S. Cl. ..... 52/531; 52/532

[58] Field of Search ..... 52/522, 532, 531, 528, 52/542

[56] References Cited

U.S. PATENT DOCUMENTS

| | | | |
|---|---|---|---|
| 214,027 | 4/1879 | Currier | 52/543 |
| 339,945 | 4/1886 | Snowden | 52/542 |
| 370,317 | 9/1887 | Cortright | 52/522 |
| 381,318 | 4/1888 | Barker | 52/531 |
| 453,743 | 6/1891 | Heller | 52/522 |
| 466,850 | 1/1892 | Goodwin | 52/528 |
| 841,276 | 1/1907 | Stasch | 52/522 |
| 946,686 | 1/1990 | Reynolds | 52/536 |
| 1,086,915 | 2/1914 | Hoffman | 52/531 |
| 1,156,053 | 10/1915 | Brown | 52/522 |
| 1,295,107 | 2/1919 | Brague | 52/529 |
| 1,559,967 | 11/1925 | King | 52/522 |
| 2,027,321 | 1/1936 | Rateike | 52/531 |
| 2,258,509 | 10/1941 | Key | 52/529 |
| 4,423,581 | 1/1984 | Miller | 52/531 |

*Primary Examiner*—David A. Scherbel
*Assistant Examiner*—Creighton Smith
*Attorney, Agent, or Firm*—Burns, Doane, Swecker & Mathis

[57] ABSTRACT

A sheet metal cladding panel for cladding facades, walls and roofs, said panel (1) including a middle portion (2) between upwardly folded edge sides (4, 11), of which at least one has a portion (12) bent outwardly-downwardly to form a flange or half seam for joining juxtaposed panels to each other. To obtain simplified erection of such panels the edge side (11) formed with the half seam (12) is, as is the half seam (12), formed with a double wall along at least a part of the panel, and terminates in an attachment flange (6) projecting out from the edge side (11) for fastening the panel to a substructure.

13 Claims, 3 Drawing Sheets

CLADDING PANEL

This application is a continuation of application Ser. No. 07/476,472, filed as PCT/SE88/00663, Dec. 5, 1988, now abandoned.

The present invention relates to facade and roof cladding for buildings of different kinds, and more specifically to a cladding panel of sheet metal, e.g. surface-treated steel, aluminium, or copper sheeting for facades, walls and roofs, said panel including a middle portion with folded-up side edge portions, of which at least one has an edge portion folded downwards and outwards to form a standing seam for joining one panel to a juxtaposed panel in accordance with the invention.

For cladding building facades and also roofing cladding there are a number of different sheet metal cladding panels on the market, all of which having the disadvantage that the erection of such panels is complicated and time-consuming. This is due to that for their attachment the known cladding panels require special fastening elements in the form of metal strips and fastening clips which are attached to the substructure with the aid of screws or nails for carrying the panel and positionally fixing it laterally. These fastening elements must thus be fastened exactly at the joint between two panels, which requires acurate positional measurement for each fastening element before they can be screwed or nailed. When the panel itself is then lifted into place, the fastening elements are folded over the side edge of the panel by hand, and when the next panel is put in place with its folded seam half gripping over the upstanding side edge of the first panel this element is then folded up around the seam half, and not until this has been done can seaming take place with the aid of a seaming machine. In addition, the known cladding panels which are mutually joined by seaming require an adaption of configuration to joining panels, which takes place by the appropriate parts of the sheet panel being cut away, which is also a time consuming work operation requiring great precision for maintaining closely fitting overlapping and seaming between the panels.

The object of the present invention is therefore to provide a sheet metal cladding panel which does not have the above-mentioned drawbacks, and can be erected simply and quickly and which does not require for its erection any special fastening elements such as fastening strips or clips, but only conventional fastening elements such as screws or nails, neither does it require any adaption of configuration to joining cladding panels, which means that cladding panels in accordance with the present invention can be supplied ready-formed from the factory.

This object is achieved by the cladding panel in accordance with the present invention having been given the distinguishing features disclosed in the accompanying claims, and in principles by the side edge of the panel provided with the folded-over half seam being formed by first folding over the edge portion, the half seam thus being of double thickness, to form a fastening flange projecting from the lower part of the upstanding side portion such as to provide for fastening the panel to a substructure. To advantage, this fastening flange can be arranged in line with the middle portion of the panel.

The invention will now be described in more detail and with reference to the accompanying drawings, on which FIG. 1 is a perspective view seen from above of an embodiment of the present cladding panel;

On the drawings, a cladding panel in accordance with the present invention is generally denoted by the numeral 1 and comprises a thin sheet of aluminum, copper or surface-treated steel, and is intended as outer wall or roof cladding. Each panel includes a middle portion 2, which can be completely flat, as illustrated on the drawings, or it can have a convex or concave cross section. This portion does not need to be completely flat, as shown on the drawings, but can be given some form of ridged cross section in its transverse and/or longitudinal direction, thus to obtain increased load carrying strength properties, which primarily applies to panels intended for use as roof cladding and which should preferably have a concave cross section for facilitating the run-off of water. If the inventive cladding panel is to be used exclusively for outer wall or facade cladding, its middle portion 2 can be provided with embossing or the like of ornamental character for obtaining a decorative surface structure.

Figure 1:
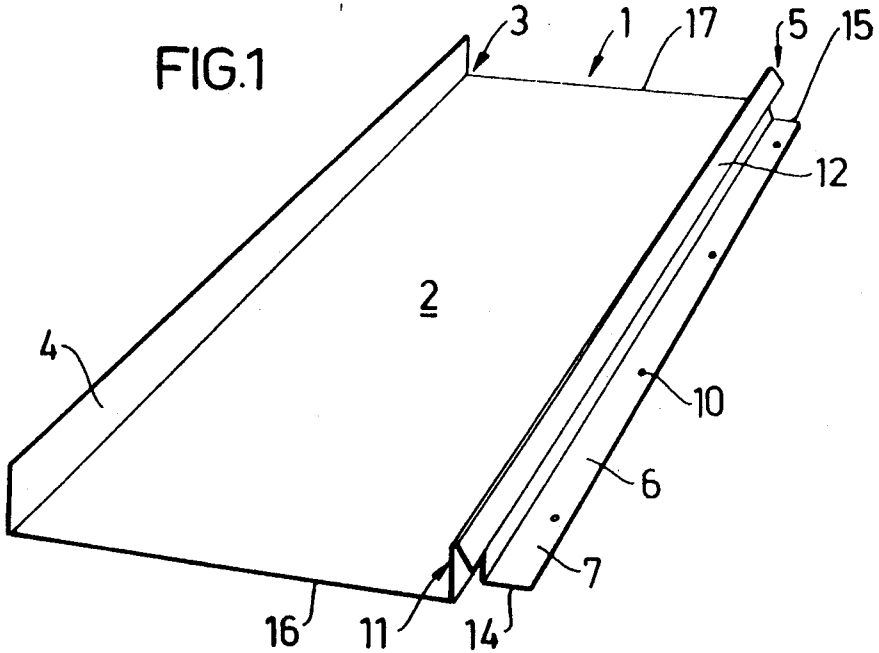
Figure 2:
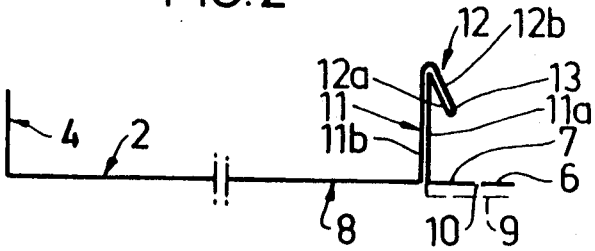
FIG. 2 is an end view of this panel.

At one longitudinal edge portion 3, each panel has en upstanding flange or side edge 4 of at least the same extension in length as the middle portion 2. At its other longitudinal edge portion 5, the element 1 is provided with an attachment flange 6, formed integrally with the middle portion 2, and which can be in the same plane as this portion, as illustrated in FIGS. 1 and 2 or somewhat below the plane or lowest point of this portion, at least to an extent corresponding to the sheet thickness. The upper side 7 of the attachment flange can thus be in line with the bottom side 8 of the middle portion, or at a distance below this portion, as indicated by a dashed line 9 in FIG. 2. The attachment flange 6 is provided with holes 10 at suitable mutual spacing for fastening means such as nails, screws or the like.

Figure 7:
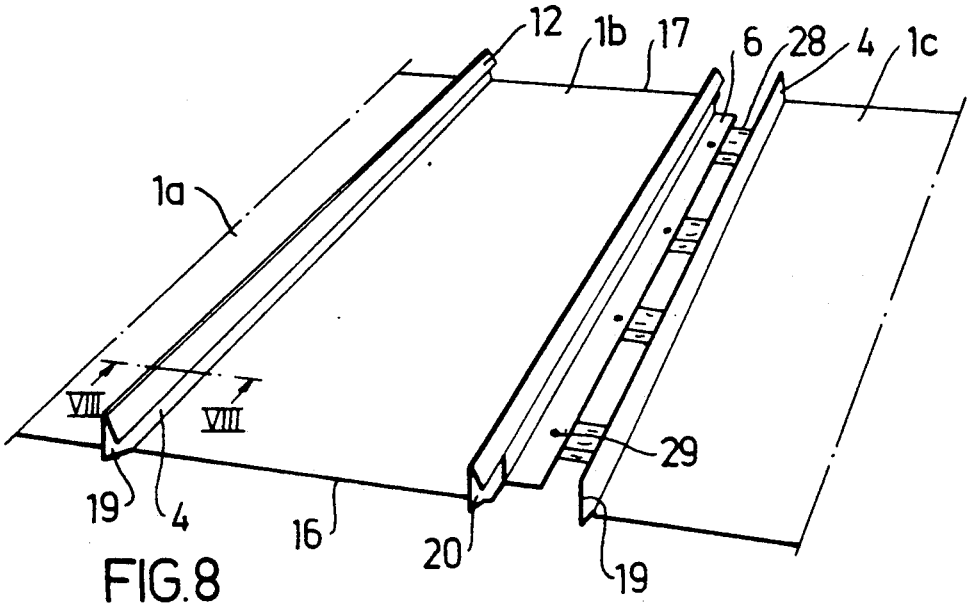
FIG. 7 illustrates in perspective, seen from above, the erection of the cladding panel in accordance with the invention.
Figure 8:
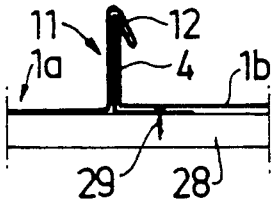
FIG. 8 is a section along the line VIII—VIII in FIG. 7.

Between the middle portion 2 of the panel and the integrally formed attachment 6 there is formed an upstanding double-wall flange or edge side 11, the upper portion of which is downwardly folded to form a half seam 12 forming an acute angle with the edge side 11. The distance from the tip 13 of this half seam to the upper side 7 of the attachment flange shall be greater than the height of the longitudinal edge side 4, which in turn shall have a height somewhat less than the distance between the upper side of the attachment flange and the apex of the half seam 12, so that the edge side 4 of the panel can be taken in behind the half seam 12 of an already fixed cladding panel 1 in accordance with the invention, as illustrated in FIGS. 7 and 8.

The ends 14, 15 of the attachment flange 6 are shortened a suitable distance inside the end edge line of the middle portion 11*b* to obtain necessary overlap between two edge portions 17 and 16 of the panel. It is also suitable here that the outer wall portion of the double-walled edge side 11 is terminated level with the end edge 14 or 15 of the attachment flange, as is also the case for the inner wall part 12*a* of the double-walled seam half, as will be clearly seen from FIG. 3.

Figure 3:
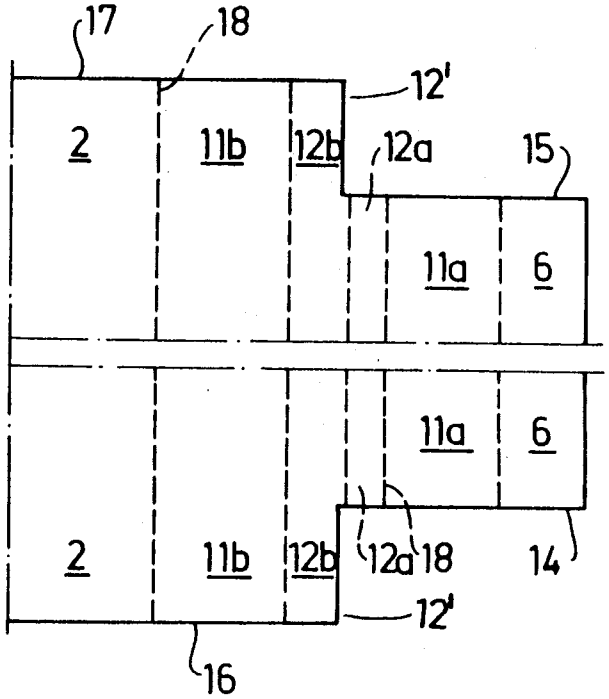
FIG. 3 is the development of a cut out corner portion of a metal sheet which is to be folded into the panel illustrated in FIG. 1.

Thus, the edge side 11 includes inner and outer walls 11*a*, 11*b*, respectively, while the half seam 12 also includes inner and outer walls 12*a*, 12*b*, respectively. As can be readily appreciated, therefore, when the panel 1 is folded, a portion of the half seam 12 is doubel-walled (as defined by the inner and outer walls 12*a*, 12*b* of the half seam 12) while the remaining portion of the half seam 12 is single walled (as defined by the outer wall 12*b* of the half seam 12). Similarly, a portion of the edge side 11 is double walled (as defined by the inner and outer walls 11*a*, 11*b* of the edge side 11) while the remaining portion of the edge side 11 is single walled (ad defined by the outer wall 11*b* of the edge side 11). Also, the single walled portions 12*b* of the half seam 12 terminate at a fold edge 12' FIG. 3 is the development of a portion of a sheet before folding into the panel 2, and shows the end portions of the edge side 5 before bending along the dashed line 18 to form the panel illustrated in FIG. 1. The necessary shaping of the sheet blank can and should thus take place before folding it into its intended shape.

As can be readily understood from FIG. 2, when the panel 1 is in the folded condition, the cross-sectional shape defined by the combination of the single walled portion of the edge side 11 and the single walled portion of the entire half seam 12 is substantially the same as the cross-sectional shape defined by the combination of the double walled portion of the edge side 11 and the double walled portion of the half seam 12.

Figure 6:
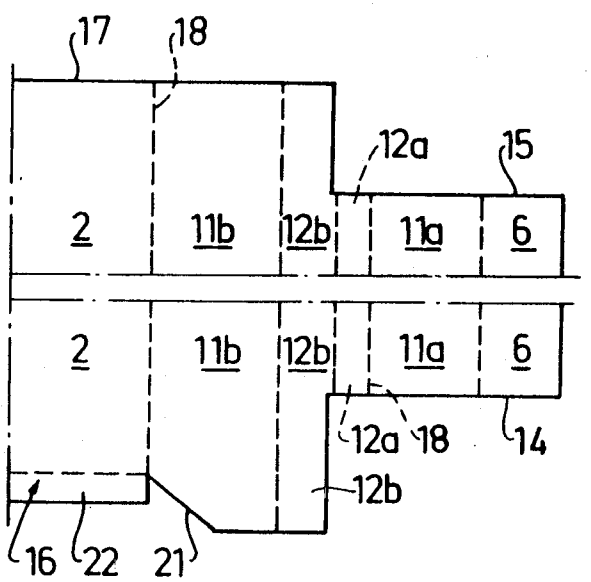
FIG. 6 is the development of this corner portion.
Figure 4:
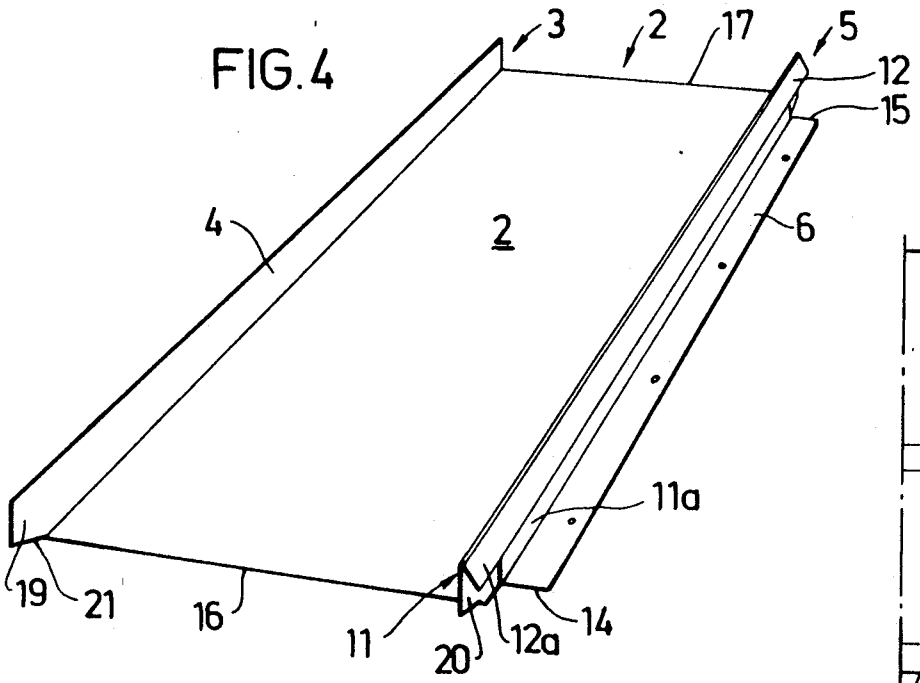
FIG. 4 is a perspective view seen from above of an embodiment of the present cladding panel for connecting to a flashing.

Another embodiment of the present cladding panel 1 is illustrated in FIG. 4, and differs from the one in FIG. 1 in that the edge sides 4 and 11 extend past the end edge 16 of the middle portion such as to form projecting tongues 19 and 20, which have their undersides 21 cut at an angle, which is best seen in FIG. 6, which illustrates the development of the end portions of the longitudinal edge portion 5 of this panel, which will be formed by folding the blank along the folding lines 18.

Figure 5:
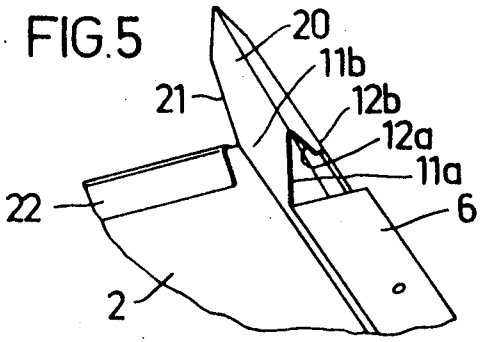
FIG. 5 is a perspective view seen from below of a corner portion of the panel according to FIG. 4.

The embodiment of the cladding panel in accordance with the invention illustrated in FIG. 4 is also provided, as distinct from the embodiment according to FIG. 1, with a flap 22 at the end 16 of its middle portion, this flap being folded at an acute angle towards the back of the middle portion to form a seam half, as illustrated in FIG. 5.

Figure 9:
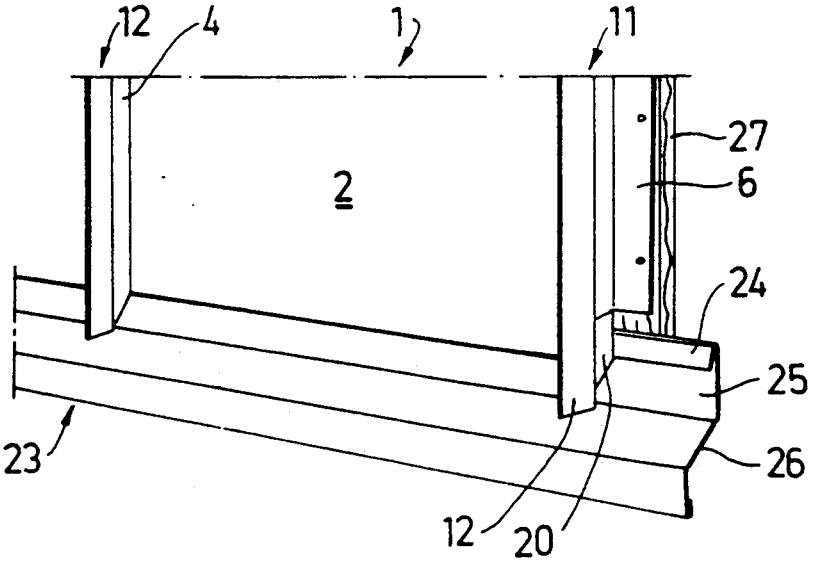
FIG. 9 is a perspective view seen from the front of the joint between a cladding panel and a flashing.

This inventive panel is intended for connection to a conventional flashing 23, as illustrated in FIG. 9, this flashing having a folded-over edge or half seam 24 which is hooked into the folded over edge 22 of the panel when the panel is put in place. The extended edge sides 4 and 11 of the panel extend along the vertical part 25 of the flashing towards its downwardly sloping, projecting part 26. The panel 1 here has its attachment flange 6 fastened to a vertical timber batten 27.

In FIG. 7 there is illustrated the erection of inventive cladding panels on transverse battens 28. The panels denoted 1*a* and 1*b* in this Figure are already fastened by screws 29 through their attachment flanges 6 to the battens 28, the panel denoted by 1*b* having its edge side inserted in the half seam 12 of the panel denoted 1*a*, as illustrated in FIG. 8. All that then remains is seaming with the aid of a seaming machine. To erect the panel denoted by 1*c*, it is only required that its edge side 4 is taken in under the half seam 12 of the panel 1*b*, both then being folded down into engagement against the battens 28 to which the unillustrated attachment flange 6 of the panel is fastened with the aid of screws 29 or nails, thus completing erection of this panel to enable continuation of erection of the next panel in the same easy manner without needing to use any other fastening elements than screws or nails. Seaming can then take place with the aid of a seaming machine, no attention needing to be paid to sheet strips and other fastening details required for fastening known sheet metal cladding panels.

The present invention is not restricted to what has been described above and illustrated on the drawings, and can be altered and modified in many different ways within the scope of the inventive concept disclosed in the claims.

I claim:

1. A sheet metal cladding panel for outer walls and roofs comprising: a middle portion, an upwardly folded flange extending along a first side of said middle portion, and an upwardly folded edge side extending along an oppositely positioned second side of said middle portion, at least said upwardly folded edge side having a downwardly folded half seam extending therefrom for joining juxtaposed panels to one another, said half seam being folded downwardly to define an acute angle with respect to said edge side, said edge side and said half seam being formed with double walls along at least a portion of their longitudinal extent to define inner and outer walls of said edge side and inner and outer walls of said half seam, the combination of said edge side and said half seam defining a cross-sectional shape that is substantially constant along substantially the entire longitudinal extent of the edge side and the half seam, the inner wall of the edge side having an attachment flange connected thereto and extending outwardly therefrom for fastening the panel to a substructure, said attachment flange, said middle portion, said edge side and said half seam having respective oppositely positioned end edges located at corresponding ends thereof, at least one of the end edges of the attachment flange being positioned inwardly of the corresponding end edge of the middle portion so that a portion of the longitudinal extent of the middle portion is absent on outwardly extending attachment flange, a portion of said edge side and a portion of said half seam being single walled, said single walled portion of said half seam and said edge side corresponding in longitudinal extent to the portion which is absent the attachment flange, said single walled portion of the half seam terminating at a free edge, the cross-sectional shape defined by the combination of the single walled portion of the edge side and the single walled portion of the entire half seam being substantially the same as the cross-sectional shape defined by the combination of the double walled portion of the edge side and the double walled portion of the half seam.

2. The panel according to claim 1, wherein the attachment flange and the middle portion are positioned in substantially the same plane when viewed in cross-section.

3. The panel according to claim 1, wherein an upper surface of the attachment flange and a lower surface of the middle portion are positioned in substantially the same plane.

4. The panel according to claim 1, wherein said attachment flange lies in a plane positioned below a plane in which lies the middle portion.

5. The panel according to claim 1, wherein said attachment flange is substantially parallel to said middle portion.

6. The panel according to claim 1, wherein both end edges of the middle portion are substantially coextensive with the corresponding end edges of the outer wall of the edge side and the outer wall of the half seam.

7. The panel according to claim 1, wherein at least one end edge of the outer wall of the edge side and at least one and edge of the outer wall of the half seam extend outwardly beyond the corresponding end edge of the middle portion.

8. The panel according to claim 7, wherein the end edge of the middle portion that does not extend as far outwardly as the corresponding end edges of the outer walls of the edge side and the half seam is folded downwardly.

9. A panel for outer walls and roofs comprising: a middle portion, an upwardly folded flange extending along a first side of said middle portion, and an upwardly folded edge side extending along an oppositely positioned second side of said middle portion, at least said upwardly folded edge side having a downwardly folded half seam extending therefrom for joining juxtaposed panels to one another, said edge side and said half seam being formed with double walls along at least a portion of their longitudinal extent to define inner and outer walls of said edge side and inner and outer walls of said half seam, the combination of the outer wall of the edge side and the outer wall of the half seam defining a cross-sectional shape that is substantially constant along its longitudinal extent and that is substantially the same as the cross-sectional shape defined by the combination of the inner wall of the edge side and the inner wall of the half seam, the inner wall of the edge side having an attachment flange connected thereto and extending outwardly therefrom for fastening the panel to a substructure, said middle portion, said edge side, said half seam and said attachment flange having respective oppositely positioned end edges located at corresponding ends thereof, at least one of the end edges of the attachment flange, the inner wall of the edge side and the inner wall of the half seam being positioned inwardly of the corresponding end edge of the middle portion so that the portion of the edge side and the portion of the half seam having inwardly positioned end edges are single walled, the inwardly positioned end edge of the attachment flange being at the same end of the panel as the inwardly positioned end edges of the inner wall of the edge side and the inner wall of the half seam, said single walled portion of the half seam terminating at a free edge, the cross-sectional shape defined by the combination of the single walled portion of the edge side and the single walled portion of the entire half seam being substantially the same as the cross-sectional shape defined by the combination of the double walled portion of the edge side and the double walled portion of the half seam.

10. The panel according to claim 9, wherein both end edges of the middle portion are substantially coextensive with the corresponding end edges of the outer wall of the edge side and the outer wall of the half seam.

11. The panel according to claim 9, wherein at least one end edge of the outer wall of the edge side and at least one end edge of the outer wall of the half seam extend outwardly beyond the corresponding end edge of the middle portion.

12. The panel according to claim 11, wherein the end edge of the middle portion that does not extend as far outwardly as the corresponding end edges of the outer walls of the edge side and the half seam is folded downwardly.

13. A panel for outer walls and roofs comprising: a middle portion, an upwardly folded flange extending along one side of said middle portion, and an upwardly folded edge side extending along an opposite side of said middle portion, at least said upwardly folded edge side having a downwardly and outwardly folded half seam extending therefrom for joining juxtaposed panels to one another, said edge side and said half seam being formed with double walls along at least a portion of their longitudinal extent to define inner and outer walls of said edge side and inner and outer walls of said half seam, the outer wall of the edge side having an attachment flange connected thereto and extending outwardly therefrom for fastening the panel to a substructure, said middle portion and said attachment flange having respective oppositely positioned end edges located at corresponding ends thereof, at least one of the end edges of the attachment flange being positioned inwardly of the corresponding end edge of the middle portion so that the portion of the edge side and the portion of the half seam having inwardly positioned end edges are single walled, the end edge of the outer wall of the edge side and the end edge of the outer wall of the half seam extending outwardly beyond the corresponding end edge of the middle portion.

* * * * *